US007827637B2

(12) United States Patent
DeFranks

(10) Patent No.: US 7,827,637 B2
(45) Date of Patent: Nov. 9, 2010

(54) MATTRESS WITH FLAME RESISTANT MOISTURE BARRIER

(75) Inventor: Michael S. DeFranks, Decatur, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 255 days.

(21) Appl. No.: 11/249,816

(22) Filed: Oct. 12, 2005

(65) Prior Publication Data

US 2006/0075567 A1 Apr. 13, 2006

Related U.S. Application Data

(60) Provisional application No. 60/618,348, filed on Oct. 12, 2004.

(51) Int. Cl.
*A47C 27/00* (2006.01)
*A47G 9/02* (2006.01)

(52) U.S. Cl. ..... 5/699; 5/484; 5/698; 5/483; 5/954; 5/737

(58) Field of Classification Search ..... 5/699, 5/484, 939, 737, 738, 490, 501, 483, 698, 5/954

See application file for complete search history.

(56) References Cited

U.S. PATENT DOCUMENTS

| | | | | |
|---|---|---|---|---|
| 2,632,187 | A | 3/1953 | Wooffendale | |
| 2,801,427 | A | 8/1957 | Crocker | |
| 2,895,145 | A | 7/1959 | Soifer | |
| 2,901,756 | A | 9/1959 | Moule | |
| 3,287,749 | A | 11/1966 | Marisco | |
| 3,493,980 | A | 2/1970 | Haller | |
| 3,512,192 | A | 5/1970 | Simon | |
| 3,581,322 | A | 6/1971 | Marisco | |
| 3,670,348 | A | 6/1972 | Irwin | |
| 3,813,715 | A | 6/1974 | Sookne | |
| 3,818,520 | A | 6/1974 | Richards, Jr. | |
| 3,818,521 | A | 6/1974 | Richards, Jr. | |
| 3,857,126 | A | 12/1974 | Woodruff | |
| 3,889,305 | A * | 6/1975 | Goldberg | 5/698 |
| 3,934,285 | A | 1/1976 | May | |
| 3,958,286 | A | 5/1976 | Rodinsky | |
| 4,031,579 | A | 6/1977 | Larned | |
| RE29,630 | E | 5/1978 | May | |
| 4,092,752 | A | 6/1978 | Dougan | |
| 4,162,393 | A | 7/1979 | Balboni | |
| 4,234,983 | A | 11/1980 | Stumpf | |
| 4,388,738 | A | 6/1983 | Wagner | |
| 4,424,600 | A | 1/1984 | Callaway | |

(Continued)

FOREIGN PATENT DOCUMENTS

| | | |
|---|---|---|
| WO | WO 03/023108 | 3/2003 |

OTHER PUBLICATIONS

Document entitled "Amicor Pure-Scientifically proves allergen reduction from the fibre's core," Heimtextil, Jan. 9-12, 2002.

*Primary Examiner*—Robert G Santos
(74) *Attorney, Agent, or Firm*—Ropes & Gray LLP

(57) ABSTRACT

A flame resistant moisture barrier and a mattress having such a barrier and related methods of manufacture provide mattresses, furniture cushions and other products that provide resistance to flame and moisture.

16 Claims, 5 Drawing Sheets

U.S. PATENT DOCUMENTS 4,430,765 A 2/1984 Karpen
4,435,864 A 3/1984 Callaway
4,449,261 A 5/1984 Magnusson
4,463,464 A 8/1984 Bost et al.
4,504,990 A 3/1985 Scales et al.
4,504,991 A 3/1985 Klancnik
4,525,409 A 6/1985 Elesh
4,526,830 A 7/1985 Ferziger et al.
4,549,323 A 10/1985 Brockhaus
4,566,926 A 1/1986 Stumpf
4,585,070 A 4/1986 Garrido
4,706,313 A 11/1987 Murphy
4,801,493 A 1/1989 Ferziger et al.
4,809,375 A 3/1989 Bull
4,865,906 A 9/1989 Smith, Jr.
4,866,799 A 9/1989 Glackin
4,903,358 A 2/1990 Creyf et al.
4,921,756 A 5/1990 Tolbert et al.
4,970,111 A 11/1990 Smith, Jr.
4,996,099 A 2/1991 Cooke et al.
5,091,243 A 2/1992 Tolbert et al.
5,101,527 A * 4/1992 Wadsworth et al. ..... 5/727
5,136,741 A 8/1992 Balonick et al.
5,149,582 A 9/1992 LaMarca, II et al.
5,249,320 A 10/1993 Moretz et al.
5,272,779 A 12/1993 Payton
5,289,602 A 3/1994 Trader
5,311,624 A 5/1994 Hutchinson
5,414,882 A 5/1995 Goodale
5,475,881 A 12/1995 Higgins et al.
5,540,980 A 7/1996 Tolbert et al.
5,566,411 A 10/1996 Eiler
5,578,368 A 11/1996 Forsten et al.
5,628,093 A 5/1997 Goodale
5,655,241 A 8/1997 Higgins et al.
5,950,264 A 9/1999 Wyner et al.
5,987,668 A 11/1999 Ackley
6,199,234 B1 3/2001 Srour et al.
6,243,900 B1 6/2001 Gladney et al.
6,334,442 B1 1/2002 Altamura
6,410,140 B1 6/2002 Land et al.
6,553,749 B2 9/2002 Land et al.
6,609,261 B1 8/2003 Mortensen et al.
6,718,583 B1 4/2004 Diaz
6,823,548 B2 4/2004 Murphy et al.
6,901,618 B2 6/2005 Oaklhill et al.
6,954,956 B1 * 10/2005 Diaz ..... 5/698
6,954,957 B2 10/2005 Metzger et al.
6,966,090 B2 11/2005 McClintock et al.
7,007,329 B2 3/2006 Metzger
7,013,514 B1 * 3/2006 Byer ..... 5/698
7,150,059 B2 * 12/2006 Small et al. ..... 5/698
7,181,794 B2 * 2/2007 Diaz ..... 5/698
7,225,487 B2 * 6/2007 Small et al. ..... 5/698
7,370,380 B2 * 5/2008 DeFranks et al. ..... 5/691
7,421,750 B2 * 9/2008 Knoff ..... 5/698
7,587,775 B2 * 9/2009 DeFranks et al. ..... 5/698
2001/0008030 A1 7/2001 Gladney et al.
2003/0129904 A1 7/2003 Wolynes et al.
2003/0229943 A1 12/2003 Lewis
2004/0060118 A1 4/2004 Diaz
2004/0060119 A1 4/2004 Murphy et al.
2004/0060120 A1 * 4/2004 Murphy et al. ..... 5/698
2004/0092184 A1 5/2004 Kingman
2004/0097156 A1 5/2004 McGuire et al.
2004/0106347 A1 6/2004 McGuire et al.
2004/0158928 A1 8/2004 Gladney
2004/0198125 A1 10/2004 Mater et al.
2004/0216237 A1 11/2004 Metzger
2005/0026528 A1 2/2005 Forsten et al.
2005/0055776 A1 3/2005 Cavazos
2005/0227558 A1 * 10/2005 Small et al. ..... 442/136
2006/0010608 A1 1/2006 DeFranks et al.
2006/0075567 A1 * 4/2006 DeFranks ..... 5/699
2006/0236462 A1 * 10/2006 Boyd ..... 5/698
2007/0199155 A1 * 8/2007 Thygsen ..... 5/737
2007/0251017 A1 * 11/2007 Speer et al. ..... 5/737
2007/0283493 A1 * 12/2007 Link et al. ..... 5/483
2008/0060137 A1 * 3/2008 Wenstrup et al. ..... 5/698
2008/0172796 A1 * 7/2008 Defranks et al. ..... 5/698
2010/0000019 A1 * 1/2010 DeFranks et al. ..... 5/691
2010/0017967 A1 * 1/2010 Murphy et al. ..... 5/698

* cited by examiner

10

MATTRESS WITH FLAME RESISTANT MOISTURE BARRIER

CROSS-REFERENCE TO OTHER PATENT APPLICATIONS

This application claims the benefit of U.S. provisional Patent Application No. 60/618,348, filed Oct. 12, 2004, the content of which is incorporated herein by reference in its entirety.

BACKGROUND

In the mattress industry, it is well known that in certain environments there is need to provide a mattress with a moisture barrier to prevent undesirable seeping or passing of fluid into lower portions of the mattress. In the case of an innerspring mattress, particularly in hospitals or other health care environments, there is a need to prevent water, urine, or other liquids from passing through the upholstered cover of the mattress and into the innerspring portion of the mattress. Once within the area of the innerspring portion of the mattress, fluids are difficult to remove and can cause undesirable effects.

Water-resistant materials, such as vinyl, have been used to provide moisture barriers. In certain designs, the moisture barrier is formed like a slip cover that may be slid over the mattress and secured by a zipper, buttons or other means. In other designs, the moisture barrier is a layer of material that is positioned under the upholstery layer but above the innercore, thereby providing a moisture barrier between the sleeping user and the innercore. But these barriers are difficult to sew or otherwise fasten within the mattress. Vinyl for instance tends to rip once it has been stitched or punctured. To address this problem, engineers and designers have developed improved materials and techniques for building mattresses. These improved materials maintain there shear strength even when stitched or otherwise punctured by a hog-ring, clip or other connector. One example of such a material is the material described in U.S. Pat. No. 5,311,624.

Although these moisture barriers can work well, they can present problems. Slip covers that provide removable upholstery tops often use zippers or some other attachment mechanism that secures the upholstery cover to the mattress core. Recent initiatives have placed restrictions and restraints on how mattresses can behave when exposed to an open flame. These attachment mechanisms, particularly zippers, can create a point of failure for an open flame test.

Accordingly, there is a need in the art for materials and systems that can act as moisture barriers without causing the mattress to fail open flame compliance testing.

SUMMARY OF THE INVENTION

The systems and methods described herein include improved mattresses and improved material layers for providing mattresses that have moisture resistant barriers that are resistant to an open flame. Additionally, the invention encompasses methods for manufacturing mattresses and for manufacturing moisture resistant materials that may be employed as barrier layers within a mattress.

In one aspect, the systems and methods described herein include, but are not limited to, a cushion having an innercore defining an upper primary surface, a liquid-resistant barrier for discouraging liquid passage, and having a liquid resistant layer for discouraging liquid passage, a structural backing layer, and at least one flame resistant layer. Optionally, the cushion may also have a cover, such as a cover of upholstery, and further optionally, the cover may be removable.

The liquid resistant layer may resist liquid and/or moisture and to that end may comprise fibers selected from the group consisting of polyurethane, polyvinylchloride, vinyl, nylon, polyester, MYLAR®, rubber, neoprene, wool, polytetrafluoroethylene (PTFE), and NANOPEL®. The liquid resistant layer may comprise a layer of material that has been given a surface treatment so that it resists penetration of moisture in at least one direction. This can be a layer of foam, cotton, wool or some other material that has been treated, typically by application of a chemical compound, such that the layer is now resistant to the passage of liquid or moisture. The liquid-resistant barrier may be disposed over a upper surface of the innercore, over a lower surface of the innercore, along a sidewall of the innercore, or disposed at any location that is to be protected from the penetration of moisture or of flame, heat or fire. In one embodiment where a removable cover is used, the flame resistant moisture barrier is arranged about the innercore so that the barrier provides a backing layer that is disposed adjacent to where any zipper, hook-and-loop fastener or other fastener will be disposed. In one further embodiment, the liquid-resistant barrier has a flame resistant layer that extends past, and is larger than, the moisture resistant layer. This allows for the flame resistant layer to be arranged at locations that benefit from flame protection, but where a moisture barrier is not necessary. In an optional embodiment, the cushion may have a removable cover where the liquid resistant layer is disposed within the removable cover.

The flame resistant layer may be any suitable flame resistant layer includes a material selected from the group of Kevlar fibers, halogenated fibers, treated fabrics and non-organic fiber materials. The flame resistant layer may comprise a plurality of layers of a flame resistant material, and may be arranged adjacent the innercore at a location proximate to a location of an attachment mechanism for securing a removable cover to the innercore.

The cushion may be a mattress, sofa cushion, futon or any other furniture cushion having an interior resilient body or core. The liquid-resistant barrier may be disposed around at least a portion of that inner-core and can be attached to that core by an attachment device such as hog rings, plastic ties, adhesive, staples and pins. In some embodiments, the innercore may be foam encases and the liquid-resistant barrier covers at least a portion of the foam sidewall. Optionally, the liquid-resistant barrier may surround all or substantially all of the innercore and to that end may be a bag-like container that is dimensionally adapted to surround at least a portion of the innercore.

In another aspect, the systems and methods described herein include a moisture barrier with a flame retardant layer and methods for manufacturing such moisture barriers and cushions, including mattresses having such layers.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

DETAILED DESCRIPTION

To provide an overall understanding of the invention, certain illustrative embodiments and practices will now be described, including a flame resistant moisture barrier layer and a mattress and a method for manufacturing a mattress that has a flame resistant moisture barrier. However, it will be understood by one of ordinary skill in the art that the systems and methods described herein can be adapted and modified and applied in other applications, such as for use in sofas, futons and other furniture or cushions for furniture, and that such other additions, modifications and uses will not depart from the scope hereof.

Figure 1A:
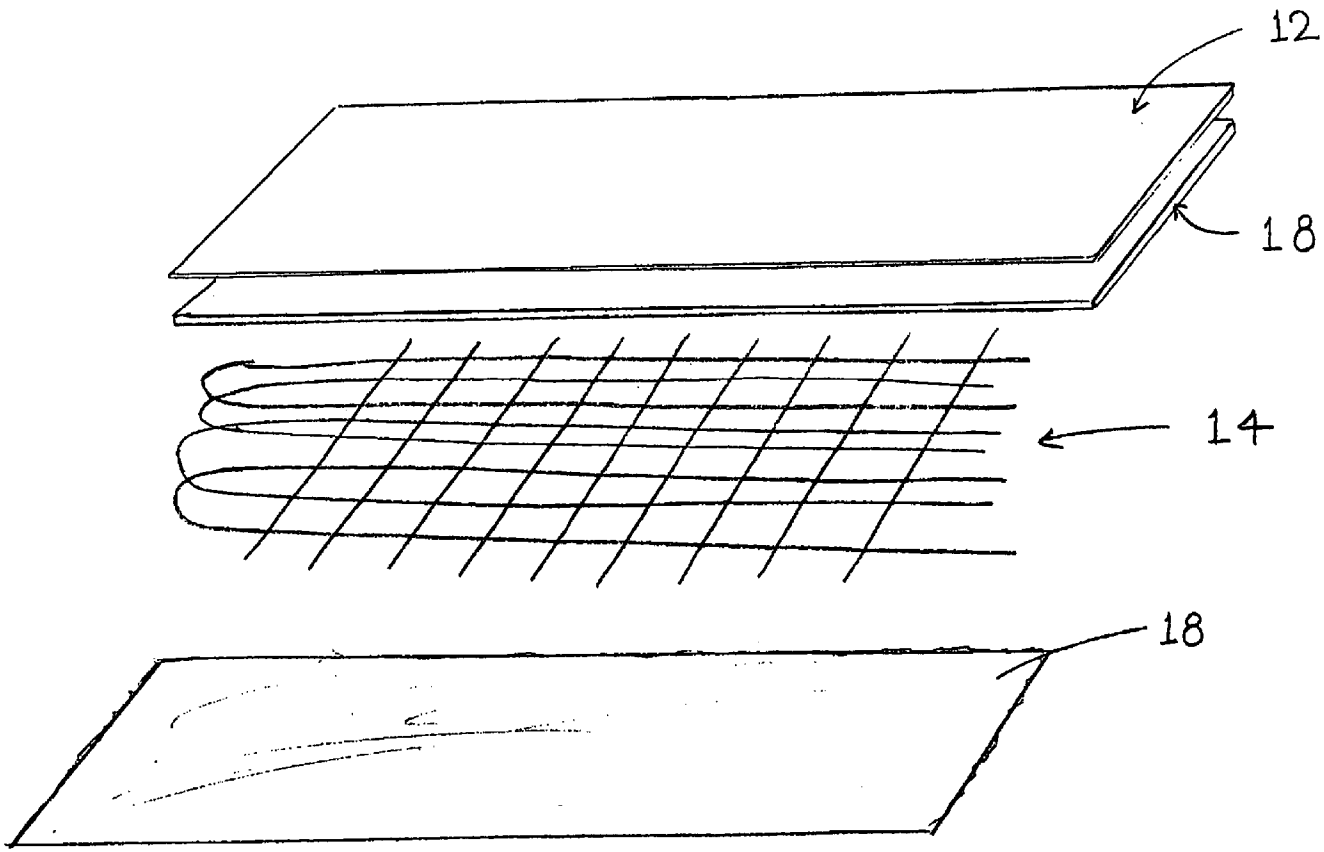
FIG. 1A depicts one embodiment of a moisture resistant material according to the invention.

Referring now to the figures, in which like numerals designate like elements throughout the several views, FIGS. 1-5 illustrate various embodiments and practices that may be realized employing the teachings described herein FIG. 1A depicts a first embodiment of a moisture resistant material having flame resistant characteristics. Specifically, FIG. 1A depicts an embodiment of the moisture resistant material 10 that includes a moisture barrier 12, a layer of backing material 14 and two layers of flame resistant material 18.

More specifically, the moisture barrier 12 may be a 1-mil PU (polyurethane) film. The moisture barrier layer 12 optionally has an anti-microbial agent additive, whether applied to its exterior surface, or added to the film during production. The antimicrobial agent may act to inhibit growth of mold, mildew and bacteria, and may by itself or in combination with the moisture barrier, prevent spread of dust mites. Other thicknesses of PU (polyurethane) film, including 2-5 mils, could also be used. Additionally, other materials may be used, either in place of polyurethane or in combination with polyurethane. Other materials may include vinyl, polyester, wool, including organic wool, plastic, treated canvas, treated cotton, or combinations of these materials, such as, combinations of layers of materials that can act as a moisture or vapor barrier. Additionally, other polymer compositions may be employed whether as sheets of material or as coatings applied to sheets of normally porous material, such as cloth, and the material selected for the moisture barrier layer 12 will depend upon the application at hand.

FIG. 1A further depicts a backing layer 14 that comprises, in this embodiment, a layer of PET (polyester) strands. In the depicted embodiments the PET (polyester) strands are at least partially overlaid to form a web-like structure commonly referred to as scrim. The strands may have any suitable thickness and typically range from 1-10 mils, and more typically from 3-5 mil. The backing layer 14 may comprise strands of other materials and thickness, such as polypropylene, polyethylene, aluminum, or fiberglass, as well as combinations of such materials. In either case, the backing layer 14 provides a structural backing layer that gives the moisture barrier 12 an increased degree of integrity, thereby reducing the likelihood of tears being formed during mattress manufacture or subsequent use. Similarly, the scrim 14 may also provide an increased degree of integrity for the flame resistant layer or layers 18.

FIG. 1A further depicts that, in this embodiment, the barrier 10 includes two layers 18 having a flame resistant material. The flame resistant material in one embodiment is KEVLAR™ and PET (polyester) binder fiber, although other suitable materials may be employed and the actual material employed will depend upon the particulars of the application, including mattress type (e.g. open coil, pocketed coil, foam, water), mattress size, material costs and other such design considerations. In the depicted embodiment, the layers 18 of flame resistant material are disposed on either side of the backing layer (the "scrim") 14. In this way the backing layer 14 is sandwiched between the two layers 18 of flame resistant material. The backing layer 14 may be joined to the layers 18 of flame resistant material by an adhesive, a solvent, ultra sonic welds, or any suitable technique. Optionally, in certain embodiments the backing layer 14 may be left unattached to one or more of the layers 18 and in such an embodiment the scrim 14 secures the peripheral edge of the innercore in place with sufficient force to prevent or reduce the likelihood of the moisture barrier 12 or flame resistant layer 18 from tearing, due to movement of the innercore.

As discussed above the depicted layer 18 is formed of KEVLAR™ fibers and PET fibers that are formed into a layer of fabric. In one practice the layer of fabric is formed by blending and joining the fibers by use of an adhesive or binder. In other embodiments, the layer 18 may be a layer of fabric formed by a weave of KEVLAR™ and PET fibers. Still other techniques may be used to form the layer 18 and any suitable technique for forming the layer 18 may be employed. The layer 18 shown in FIG. 1A uses KEVLAR fibers, but in other embodiments other suitable materials may be employed. Such other materials may be other flame resistant, or sometimes referred to as flame or fire retardant materials, and may include any of the commercially available flame resistant materials. These materials may be categorized into four general groups including inorganic materials, organophosphorous materials, halogenated organic materials (typically halogenated with Chlorine or more popularly Bromine) and nitrogen based compounds. Commercially available materials are sold under the tradenames NOMEX, KEVLAR, INDURA and others. Other materials include fire resistant balanced corespun yarn such as described in U.S. Pat. No. 5,540,980. The materials may comprise layers, or fibers incorporated into a layer, with the fibers being chopped fiber, staple fiber, spun yarn, and/or continuous filament. The type of fiber or layer used will depend upon the application. In other embodiments, the flame resistant layer may be a layer of treated material, such as cotton or polyurethane, where the treatment provides a degree of flame resistance. Fire resistant or retardant papers may also be employed. Still other flame resistant materials may be employed without departing from the scope of the invention.

Optionally, the moisture barrier 10 may have other layers including an additional layer of flame resistant material, backing material or moisture resistant material. The depicted layers may be laminated together, ultra-sonic welded, joined by adhesive or solvent or otherwise combined to form a sheet of material. The size of the sheets formed may vary according to the application, but in certain embodiments, the sheets may be sized as is conventional for mattress manufacture, which typically is about 88 inches in width.

Figure 1B:
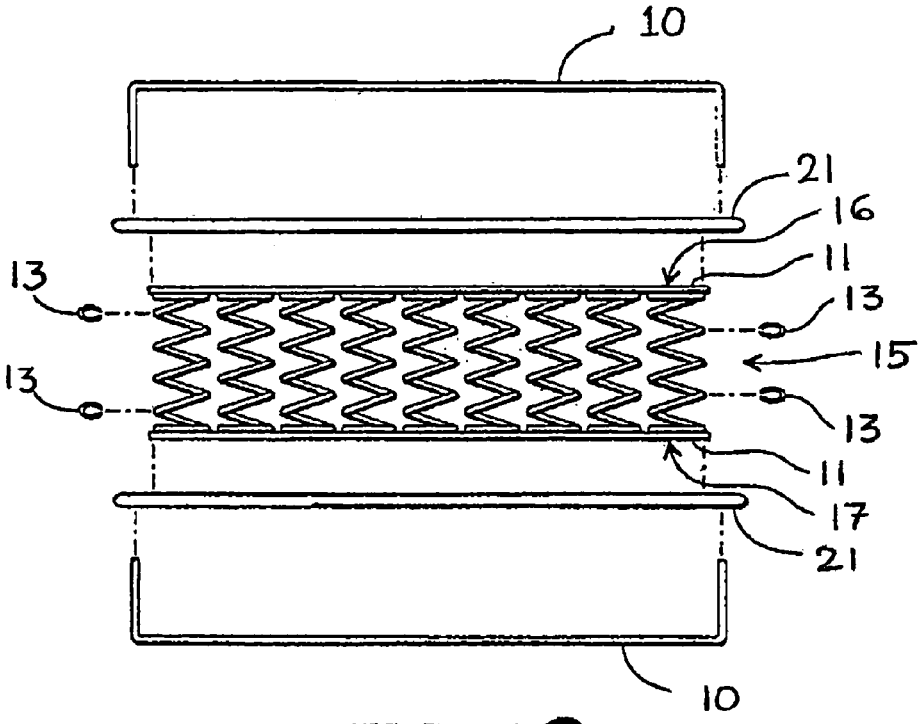
FIG. 1B is an end, exploded illustrative view of one embodiment of an innerspring construction, padding layers, and barrier layers according to the present invention.

Turning now to FIG. 1B, this Figure illustrates the material 10 of FIG. 1A being used in an innerspring mattress assembly. As may be seen, an innerspring construction 15 includes a pair of border wires 11, and defines a top surface 16 a bottom surface 17, and sides. This innerspring construction 15 may be an open-coil construction as illustrated, it may be a pocketed-coil construction as identified in U.S. Pat. No. 4,234,933 to Stumpf, hereby incorporated by reference, or a foam core, or any other suitable innercore, or combination of innercores.

The moisture barrier layer or layers 10 may be placed upon the top and bottom surfaces of the innercore construction 15, such that the layer 10 overlaps the border wires 11. This layer 10 may optionally include an insulating layer (such as fiber padding or plastic netting) and may also include cotton fiber padding, polyurethane padding, or other padding materials 21 known in the art. Upon each upholstery layer, a layer of laminated barrier material 10 is "hog-ringed" by hog rings 13 directly to the springs 22 of the innerspring construction. In one embodiment, a second layer of barrier material is "hog-ringed" to the lower border wire 11, and wrapped over the bottom surface 17 of the innercore, such that another flame resistant moisture barrier layer is used to completely encompass the innercore construction and upholstery materials. Hog-ringing is a conventional means of attaching fabric or padding to an innerspring construction, although other mechanical or adhesive means may be used, including plastic tabs, plastic or elastic bands, and staples.

Figure 2:
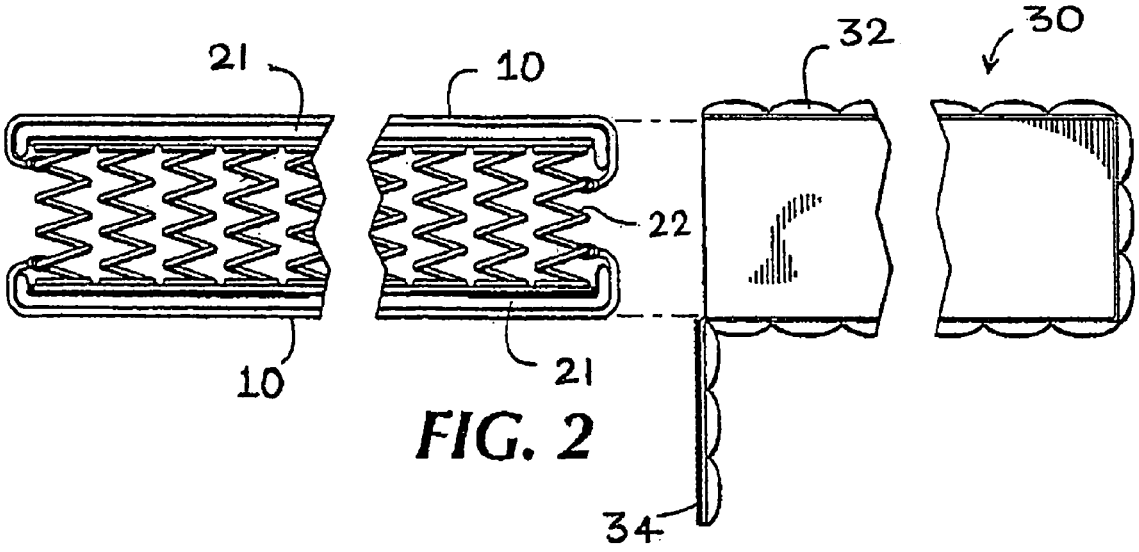
FIG. 2 is an end, assembled view of the above elements, plus a removable cover detached therefrom.

In the depicted embodiment, the barrier 10 is arranged to sit between the upper surface 16 of the innercore 15 and the upholstery and another sheet of the barrier 10 is disposed between the lower surface 17 of the innercore 15 and the upholstery on the lower side or bottom side of the mattress or cushion. In optional embodiments, the barrier 10 may also be disposed along the sidewalls of the innercore 15, or portions of the sidewall. For example, in embodiments with a removable upholstery cover a zipper or other fastener is located on the cover to allow removal of the cover from the mattress. In such an embodiment, the barrier 10 may be arranged so that it is disposed about the innercore at any location adjacent to the zipper or fastener. For example, FIG. 2 depicts a removable cover 30 that has a zipper 34 that extends down the sidewall of the innercore 15. In this embodiment, the barrier 10, or at least the flame resistant layer of the barrier 10, may also be disposed along the portion of the innercore sidewall that is adjacent zipper 34 to provide a flame resistant backing for the zipper 34.

After the barrier material 10 and upholstery layers are in place, the innercore construction may then be conventionally upholstered (not shown), or the removable cover 30 may be placed on the innerspring constructions, as shown in FIG. 2. This removable cover 30 may be composed of conventional upholstery material 32 such as is used in conventional non-removable mattress covers, and may be secured in place by closing a zipper to secure a lid 34 to provide a complete enclosure of the innercore construction and barrier material. The upholstery layer of the cover 30 may comprise one of either manmade or natural fiber materials, or blends thereof. In one embodiment, such fabric layer comprises a nylon material laminated for example by heat bonding to a sub-layer of foam or to several sub-layers of foam. Other materials may be employed, such as polyester or terrycloth materials or blends thereof, organic materials of down, wool or cotton or other materials. Also, the cover may comprise fabric layers that are machine washable. The cover 30 may be quilted or convoluted to provide a finished exterior. The cover 30 may attach by zipper 34 or hook-and-loop fasteners may also be used if desired, or some other fastener or combination of fasteners. The resulting mattress or cushion has a finished appearance.

As may be understood, if a mattress or cushion encounters a liquid spill on, for example, its top surface, the liquid will tend (if conventional upholstery is used) to seep into the upholstery. If the spillage is large enough, the liquid may seep entirely through the cover and encounter the barrier layer. At that point it preferably will be stopped or at least impeded. As may be understood, this is desirable in that the springs or foam of the innercore of the mattress are not soiled, which as discussed above is disadvantageous in that the springs and padding layers are difficult to clean or even to access, especially in the case of pocketed coils.

Figure 3:
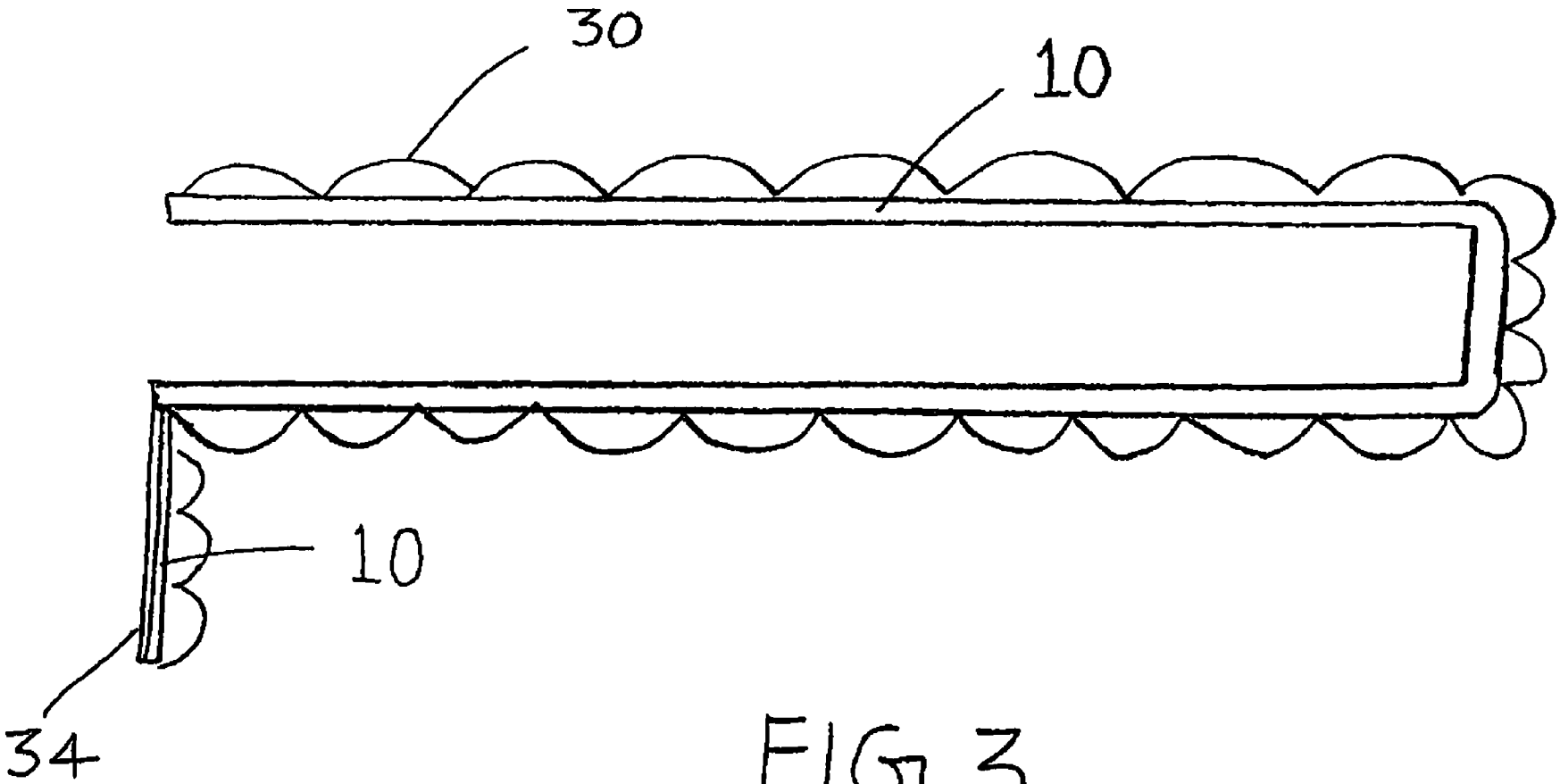
FIG. 3 is an alternate embodiment of the invention.

It may be understood that alternative embodiments exist to provide a mattress with a flame resistant moisture barrier. FIG. 3 illustrates one alternative embodiment wherein the flame resistant moisture barrier is built into the inside surface of the removable cover 30. As shown, the removable cover 30 may have a sheet of material 10 attached to one or more of its inside surfaces. Optionally, the flame resistant layer may surround or be located adjacently to the portion of the innercore where the zipper 34 is located to provide additional flame resistance at the location of the zipper 34. An optional backing layer of FR (fire resistant) material may be provided as well as an optional layer of FR material that covers zipper 34. The zipper 34 may extend along the sidewalls of the cushion or around a peripheral edge of the cushion or any other suitable location, and the barrier 10 may be located adjacent the zipper 34.

Figure 4:
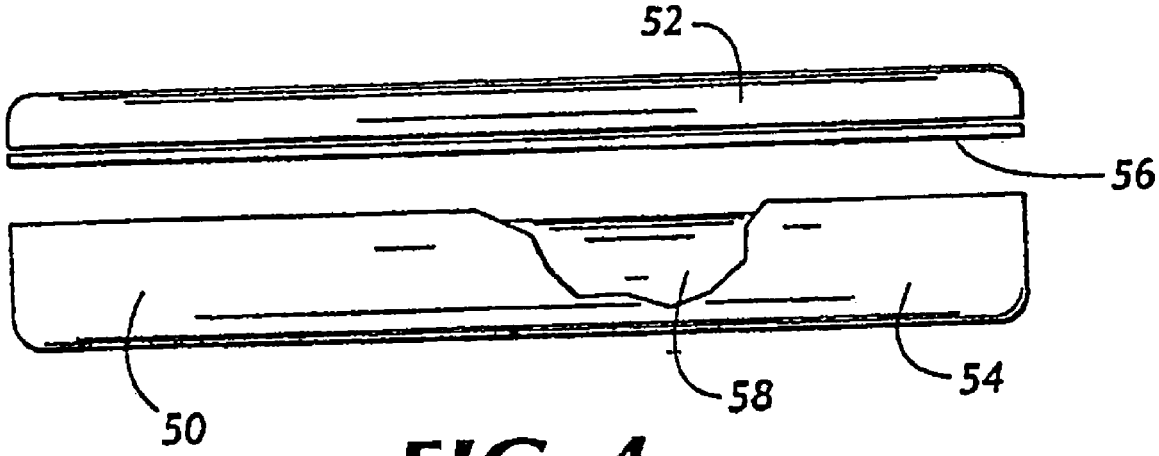
FIG. 4 is a side, exploded view of a water mattress according to the present invention.

Another embodiment is shown in FIG. 4 for a water mattress 50. As shown, a laminated flame retardant, moisture resistant barrier layer 56 may also be sewn into the top cover portion 52 of a water mattress 50, to provide a barrier to water or moisture which may escape from the inner water bladder(s) 58 within the mattress 50. The construction of the moisture resistant layer 56, as can be seen from the above description of layers depicted in FIGS. 1A-1B readily accommodates such sewing, with improved resistance to tearing or ripping even after sewing.

Figure 5:
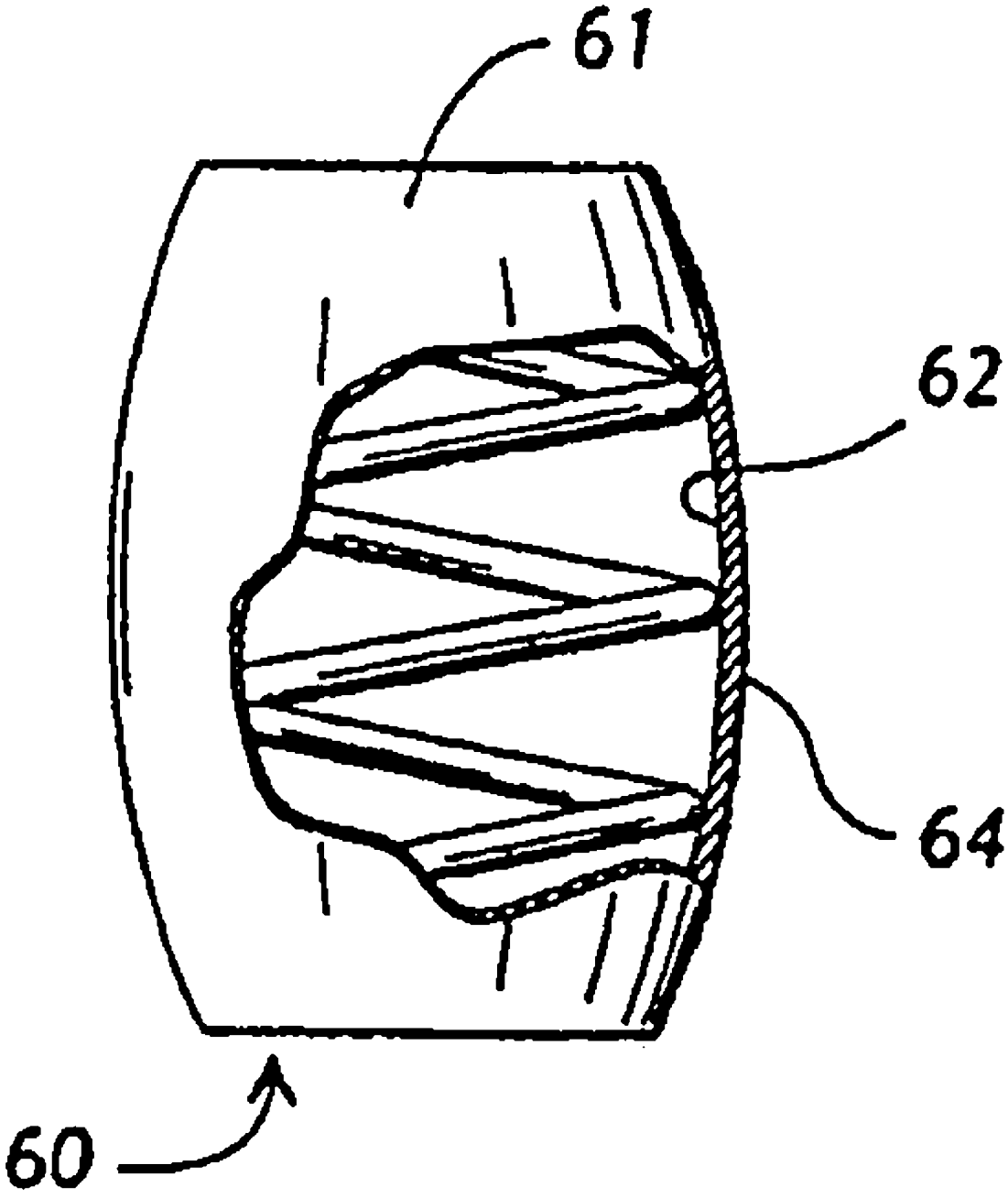
FIG. 5 is a partial cutaway view of the side of a pocketed coil according to the present invention.

As seen in FIG. 5, an improved pocketed coil construction 60 is also provided under the present invention. This pocketed coil construction 60 includes a spring 61 which is encased in a 4-ply fabric cover (as set forth in U.S. Pat. No. 4,234,933 to Stumpf). This 4-ply laminated barrier material (shown as 40 in FIG. 3) includes an exterior water- or moisture-impervious layer, a structural backing layer, and two flame resistant layers. In this construction 60, it may be seen that the encased spring 61, typically made of metal, is protected by the moisture barrier.

It should be understood that the fabric on the springs could also be reversed, i.e., the structural backing layer is on the outside, or the moisture barrier and or flame resistant layer are sandwiched between two scrim layers. Other arrangements of the layers of barriers 10 may be used without departing from the scope of the invention. It should also be understood that foam, plastic springs, or other resilient material, could also be used as a substitute for metal innerspring constructions and the moisture barrier described herein can protect those alternate springs and resilient materials.

In another aspect, the invention provides methods for manufacturing sheets or layers of moisture resistant and flame resistant material and for manufacturing cushions, such as sofa cushions and mattresses having such barriers. The material may be manufactured as described above to provide rolls of material that may be used to form the mattresses and other products described herein.

Therefore, it may be seen that a mattress construction is provided which provides improved resistance to soiling by water, water vapor, or other liquids or vapors as well as to open flames. An improved water mattress construction is also provided which reduces the chances of leakage of the interior water. While this invention has been described in specific detail with reference to the disclosed embodiments, it will be understood that many variations and modifications may be effected within the spirit and scope of the invention as described in the appended claims. For example, the mattress may include a foam core, or a combination of foam and springs. The mattress may be one-sided or two-sided. The fire resistant layer may be used in any furniture cushion, including car seats, sofa cushions, and futons. Other applications may include use with pillows, mattress covers, bedspreads, draperies, protective apparel, field fire shelters, and the like. Consequently, those skilled in the art will know or be able to ascertain using no more than routine experimentation, many equivalents to the embodiments and practices described herein. Accordingly, it will be understood that the invention is not to be limited to the embodiments disclosed herein, but is to be understood from the following claims, which are to be interpreted as broadly as allowed under the law.

I claim:

1. A cushion construction, comprising:

an innercore defining an upper primary surface, a liquid-resistant barrier, disposed internally to the cushion construction and adjacent to the innercore, for discouraging liquid passage, and having, a liquid resistant layer for discouraging liquid passage;

a structural backing layer disposed adjacent to the liquid resistant layer and spaced apart from the innercore, and at least one flame resistant layer disposed between the innercore and the liquid resistant layer.

2. A cushion according to claim 1, further comprising a removable cushion cover.

3. A cushion according to claim 1, wherein the liquid resistant layer comprises fibers selected from the group consisting of polyurethane, polyvinylchloride, vinyl, nylon, polyester, mylar, rubber, neoprene, wool, polytetrafluoroethylene (PTFE), and nanopel.

4. A cushion according to claim 1, wherein the liquid resistant layer comprises a layer of material having a surface treatment for resisting penetration of moisture in at least one direction.

5. A cushion according to claim 1, wherein the liquid-resistant barrier is disposed over the upper primary surface of the innercore.

6. A cushion according to claim 1, wherein the innercore has a primary lower surface and further comprising a second flame-resistant layer disposed over the lower primary surface of the innercore.

7. A cushion according to claim 1, wherein the innercore has at least one side wall and further comprising a second flame-resistant layer disposed over a portion of the at least one side wall.

8. A cushion according to claim 1, wherein the cushion has a lower primary surface and further comprising a second liquid-resistant barrier disposed over the lower primary surface of the innercore.

9. A cushion according to claim 2, wherein the liquid resistant layer is disposed within the removable cover.

10. A cushion according to claim 1, wherein the at least one flame resistant layer includes a material selected from the group of Kevlar fibers, halogenated fibers, treated fabrics and non-organic fiber materials.

11. A cushion according to claim 1, wherein the liquid-resistant barrier couples to the innercore by an attachment device selected from the group consisting of hog rings, plastic ties, adhesive, staples and pins.

12. A cushion according to claim 1, further comprising a foam sidewall arranged about at least a portion of a sidewall of the innercore and wherein the liquid-resistant barrier covers at least a portion of the foam sidewall.

13. A cushion according to claim 1, wherein the liquid-resistant barrier comprises a container dimensionally adapted to surround at least a portion of the innercore.

14. A cushion according to claim 1, wherein the at least one flame resistant layer comprises a plurality of layers of a flame resistant material.

15. A cushion according to claim 1, wherein the flame-resistant layer is arranged adjacent the innercore at a location proximate to a location of an attachment mechanism for securing a removable cover to the innercore.

16. A method for manufacturing a mattress, comprising the steps of providing an innercore, and attaching a liquid-resistant barrier to at least one surface of the innercore, wherein the liquid-resistant barrier is disposed adjacent to the innercore and comprises:

a liquid resistant layer for discouraging liquid passage;

a structural backing layer disposed adjacent to the liquid resistant layer and spaced apart from the innercore; and at least one flame resistant layer disposed between the innercore and the liquid resistant layer.

* * * * *